US010415591B2

(12) United States Patent
Fessenden et al.

(10) Patent No.: US 10,415,591 B2
(45) Date of Patent: Sep. 17, 2019

(54) GAS TURBINE ENGINE AIRFOIL

(71) Applicant: United Technologies Corporation, Farmington, CT (US)

(72) Inventors: Robert W Fessenden, Manchester, CT (US); Abhir A Adhate, Hamden, CT (US); Yuan Dong, Glastonbury, CT (US); Sean Nolan, Wethersfield, CT (US); Li Xing Pan, Middletown, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 394 days.

(21) Appl. No.: 15/272,310

(22) Filed: Sep. 21, 2016

(65) Prior Publication Data

US 2018/0080472 A1 Mar. 22, 2018

(51) Int. Cl.

| | |
|---|---|
| ***F04D 29/52*** | (2006.01) |
| ***F04D 29/32*** | (2006.01) |
| ***F01D 11/14*** | (2006.01) |
| ***F04D 29/16*** | (2006.01) |
| ***F01D 5/12*** | (2006.01) |
| ***F01D 25/24*** | (2006.01) |

(52) U.S. Cl.

CPC ..... *F04D 29/526* (2013.01); *F01D 11/14* (2013.01); *F04D 29/164* (2013.01); *F04D 29/324* (2013.01); *F01D 5/12* (2013.01); *F01D 25/24* (2013.01); *F05D 2220/32* (2013.01); *F05D 2230/50* (2013.01)

(58) Field of Classification Search

CPC .... F04D 29/526; F04D 29/164; F04D 29/324; F04D 29/642; F04D 15/0033; F01D 5/12; F01D 25/24

See application file for complete search history.

(56) References Cited

U.S. PATENT DOCUMENTS 4,238,170 A * 12/1980 Robideau ..... F01D 11/08 415/173.5
4,239,452 A * 12/1980 Roberts, Jr. ..... F01D 11/12 415/173.5

(Continued)

FOREIGN PATENT DOCUMENTS

EP 1923539 5/2008

OTHER PUBLICATIONS

Bunker, Ronald S., 2006, "Axial Turbine Blade Tips: Function, Design, and Durability", AIAA Journal of Propulsion and Power, 22, No. 2, pp. 271-285. accessed on Dec. 11, 2108 from https://arc.aiaa.org/doi/pdf/10.2514/1.11818 (Year: 2006).*

(Continued)

*Primary Examiner* — Richard A Edgar
*Assistant Examiner* — Topaz L. Elliott
(74) *Attorney, Agent, or Firm* — Snell & Wilmer, L.L.P.

(57) ABSTRACT

A compressor may include an airfoil configured to rotate about an axis. The airfoil may have a span measured radially from a root of the airfoil to a tip of the airfoil. A compressor case may be radially adjacent to the airfoil. The airfoil and the compressor case may define a clearance between the tip of the airfoil and a radially inner surface of the compressor case. A ratio of the clearance to the span may be between 1.5 to 2.5 percent.

13 Claims, 4 Drawing Sheets

(56) References Cited

U.S. PATENT DOCUMENTS

| | | | | |
|---|---|---|---|---|
| 6,935,836 | B2 * | 8/2005 | Ress, Jr. | F01D 11/025 415/173.2 |
| 7,823,389 | B2 * | 11/2010 | Seitzer | F01D 11/24 60/782 |
| 8,562,289 | B2 * | 10/2013 | Kobayashi | F04D 29/522 415/173.1 |
| 2006/0140756 | A1 | 6/2006 | Schwarz | |
| 2014/0165592 | A1 | 6/2014 | Key | |
| 2014/0216087 | A1 * | 8/2014 | Sishtla | F04D 29/058 62/228.1 |
| 2018/0230946 | A1 * | 8/2018 | Virtue, Jr. | F02K 3/068 |

OTHER PUBLICATIONS

Dong, Yang & Zheng, Xinqian & Qiushi, Li. (2014). An 11-stage axial compressor performance simulation considering the change of tip clearance in different operating conditions. Proceedings of the Institution of Mechanical Engineers, Part A: Journal of Power and Energy. 228, No. 6, pp. 614-625. (Year: 2014).*

DiOrio, Austin G. "Small Core Axial Compressor for High Efficiency Jet Aircraft" Massachusetts Institutes of Technology, 2012. accessed from https://dspace.mit.edu/bitstream/handle/1721.1/77107/825066815-MIT.pdf?sequence=2 on Dec. 12, 2018. (Year: 2012).*

Remarks filed Sep. 26, 2018 in corresponding EPO Application No. 17181892.5 (3299587) (Year: 2018).*

European Patent Office, European Search Report dated Jan. 23, 2018 in Application No. 17181892.5-1006.

* cited by examiner

GAS TURBINE ENGINE AIRFOIL

GOVERNMENT LICENSE RIGHTS

This disclosure was made with government support under contract No. NNC14CA36C awarded by the National Aeronautics and Space Administration (NASA). The government has certain rights in the disclosure.

FIELD

The present disclosure relates generally to components of gas turbine engines and, more specifically, to airfoils of small-core gas turbine engines.

BACKGROUND

Gas turbine engines typically include a compressor section, a combustor section and a turbine section. In general, during operation, air is pressurized in the compressor section and is mixed with fuel and burned in the combustor section to generate hot combustion gases. The hot combustion gases flow through the turbine section, which extracts energy from the hot combustion gases to power the compressor section and other gas turbine engine loads.

One potential limiting factor in gas turbine engines may be the efficiency and stability of the compression and turbine systems. Efficiency and stability of an axial compressor may be limited by the engine size and the engine operating conditions. Compressor stall may also be a limiting factor in gas turbine engines. The initiation of a stall may be driven by the tip leakage flow through the tip clearance between an airfoil and the outer diameter of the compressor. Scaling down of a gas turbine engine may result in a relatively larger tip clearance in the compressors and turbines of small-core gas turbine engines. Scaling constraints may cause small-core gas turbine engines to be less efficient relative to larger gas turbine engines.

SUMMARY

A compressor in accordance with various embodiments may comprise an airfoil configured to rotate about an axis. The airfoil may have a span measured radially from a root of the airfoil to a tip of the airfoil. A compressor case may be radially adjacent to the airfoil. The airfoil and the compressor case may define a clearance between the tip of the airfoil and a radially inner surface of the compressor case. A ratio of the clearance to the span may be between 1.5 to 2.5 percent.

In various embodiments, the ratio of the clearance to the span may be between 2.0 to 2.5 percent. The airfoil may be a high pressure compressor airfoil. A mass flow rate of the compressor may be 3.0 pounds-mass per second or less. The span of the airfoil may be between 12.7 millimeters and 15.24 millimeters. The span of the airfoil may be between 14.73 millimeters and 15.24 millimeters. The clearance may be configured to prevent contact between the tip of the airfoil and the radially inner surface of the compressor case. The airfoil may be positioned in an aft end of the compressor.

A gas turbine engine in accordance with various embodiments may comprise an engine section comprising at least one of a turbine section and a compressor section. An airfoil may be positioned within the engine section and configured to rotate about an axis. The airfoil may have a span measured radially from a root of the airfoil to a tip of the airfoil. An engine case may be radially adjacent to the airfoil. The airfoil and the engine case may define a clearance between the tip of the airfoil and a radially inner surface of the engine case. A ratio of the clearance to the span may be between 1.5 to 2.5 percent.

In various embodiments, the ratio of the clearance to the span may be between 2.0 to 2.5 percent. The airfoil may be a high pressure compressor airfoil. The engine case may be a compressor case. The span of the airfoil may be between 12.7 millimeters and 15.24 millimeters. The span of the airfoil may be between 14.73 millimeters and 15.24 millimeters. The engine section is an aft portion of a high pressure compressor.

A method of increasing gas turbine engine efficiency may comprise forming an airfoil configured to rotate about an axis. The airfoil may have a span measured radially from a root of the airfoil to a tip of the airfoil. The method may include disposing an engine case radially adjacent to the airfoil. The airfoil and the engine case may define a clearance between the tip of the airfoil and a radially inner surface of the engine case. The method may include reducing a ratio of the clearance to the span to between 1.5 to 2.5 percent.

In various embodiments, reducing the ratio of the clearance to the span includes increasing the span of the airfoil relative to a diameter of the engine case. Increasing the span of the airfoil may include increasing the span of the airfoil to between 12.7 millimeters and 15.24 millimeters. Reducing the ratio of the clearance to the span may include decreasing a diameter of the engine case. The airfoil may be a high pressure compressor airfoil and the engine case is a compressor case.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be exemplary in nature and non-limiting.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the drawing figures, wherein like numerals denote like elements.

DETAILED DESCRIPTION

All ranges and ratio limits disclosed herein may be combined. It is to be understood that unless specifically stated otherwise, references to "a," "an," and/or "the" may include one or more than one and that reference to an item in the singular may also include the item in the plural.

The detailed description of various embodiments herein makes reference to the accompanying drawings, which show various embodiments by way of illustration. While these various embodiments are described in sufficient detail to enable those skilled in the art to practice the disclosure, it should be understood that other embodiments may be realized and that logical, chemical, and mechanical changes may be made without departing from the spirit and scope of the disclosure. Thus, the detailed description herein is presented for purposes of illustration only and not of limitation. For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, connected, or the like may include permanent, removable, temporary, partial, full, and/or any other possible attachment option. Additionally, any reference to without contact (or similar phrases) may also include reduced contact or minimal contact. Cross hatching lines may be used throughout the figures to denote different parts but not necessarily to denote the same or different materials.

As used herein, "aft" refers to the direction associated with the tail (e.g., the back end) of an aircraft, or generally, to the direction of exhaust of the gas turbine engine. As used herein, "forward" refers to the direction associated with the nose (e.g., the front end) of an aircraft, or generally, to the direction of flight or motion.

As used herein, "distal" refers to the direction radially outward, or generally, away from the axis of rotation of a turbine engine. As used herein, "proximal" refers to a direction radially inward, or generally, towards the axis of rotation of a turbine engine.

Figure 1:
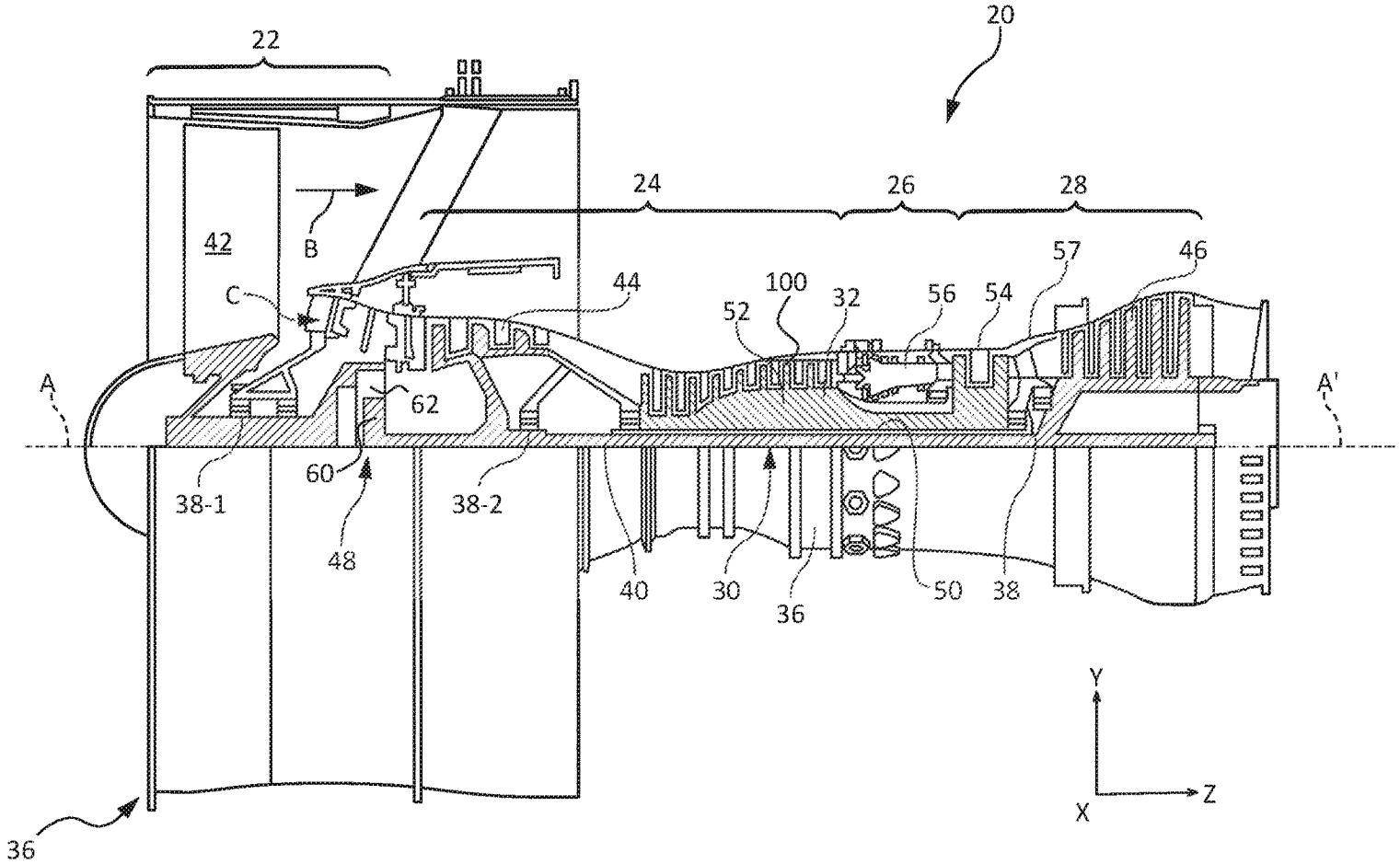
FIG. 1 illustrates a cross-sectional view of an exemplary gas turbine engine, in accordance with various embodiments.

With reference to FIG. 1, a gas-turbine engine 20 is provided. Gas-turbine engine 20 may be a two-spool turbofan that generally incorporates a fan section 22, a compressor section 24, a combustor section 26 and a turbine section 28. Alternative engines may include, for example, an augmentor section among other systems or features. In operation, fan section 22 can drive coolant along a bypass flow-path B while compressor section 24 can drive coolant along a path of core airflow C for compression and communication into combustor section 26 then expansion through turbine section 28. Although depicted as a turbofan gas-turbine engine 20 herein, it should be understood that the concepts described herein are not limited to use with turbofans as the teachings may be applied to other types of turbine engines including three-spool architectures.

Gas-turbine engine 20 may generally comprise a low speed spool 30 and a high speed spool 32 mounted for rotation about an engine central longitudinal axis A-A' relative to an engine static structure or engine case 36 via several bearing systems 38, 38-1, and 38-2. It should be understood that various bearing systems 38 at various locations may alternatively or additionally be provided, including for example, bearing system 38, bearing system 38-1, and bearing system 38-2.

Low speed spool 30 may generally comprise an inner shaft 40 that interconnects a fan 42, a low pressure compressor section 44 and a low pressure turbine section 46. Inner shaft 40 may be connected to fan 42 through a geared architecture 48 that can drive fan 42 at a lower speed than low speed spool 30. Geared architecture 48 may comprise a gear assembly 60 enclosed within a gear housing 62. Gear assembly 60 couples inner shaft 40 to a rotating fan structure. High speed spool 32 may comprise an outer shaft 50 that interconnects a high pressure compressor 52 and high pressure turbine 54. A combustor 56 may be located between high pressure compressor 52 and high pressure turbine 54. Mid-turbine frame 57 may support one or more bearing systems 38 in turbine section 28. Inner shaft 40 and outer shaft 50 may be concentric and rotate via bearing systems 38 about the engine central longitudinal axis A-A', which is collinear with their longitudinal axes. As used herein, a "high pressure" compressor or turbine experiences a higher pressure than a corresponding "low pressure" compressor or turbine.

The core airflow C may be compressed by low pressure compressor section 44 then high pressure compressor 52, mixed and burned with fuel in combustor 56, then expanded over high pressure turbine 54 and low pressure turbine 46. Turbines 46, 54 rotationally drive the respective low speed spool 30 and high speed spool 32 in response to the expansion.

Gas-turbine engine 20 may be, for example, a high-bypass ratio geared aircraft engine. In various embodiments, the bypass ratio of gas-turbine engine 20 may be greater than about six (6). In various embodiments, the bypass ratio of gas-turbine engine 20 may be greater than ten (10). In various embodiments, geared architecture 48 may be an epicyclic gear train, such as a star gear system (sun gear in meshing engagement with a plurality of star gears supported by a carrier and in meshing engagement with a ring gear) or other gear system. Geared architecture 48 may have a gear reduction ratio of greater than about 2.3 and low pressure turbine 46 may have a pressure ratio that is greater than about five (5). In various embodiments, the bypass ratio of gas-turbine engine 20 is greater than about ten (10:1). In various embodiments, the diameter of fan 42 may be significantly larger than that of the low pressure compressor section 44, and the low pressure turbine 46 may have a pressure ratio that is greater than about five (5:1). Low pressure turbine 46 pressure ratio may be measured prior to inlet of low pressure turbine 46 as related to the pressure at the outlet of low pressure turbine 46 prior to an exhaust nozzle. It should be understood, however, that the above parameters are exemplary of various embodiments of a suitable geared architecture engine and that the present disclosure contemplates other turbine engines including direct drive turbofans.

Each of the compressor section 24 and the turbine section 28 may include alternating rows of rotor blade assemblies and vane assemblies (shown schematically) that carry airfoils that extend into the path of core airflow C. The blade assemblies have one or more sets of rotating blades, which may rotate about engine central longitudinal axis A-A'. Blade assemblies may rotate with respect to static components of gas turbine engine 20, such as the vane assemblies and engine case 36. A clearance is maintained between rotating blade assemblies and static components in order to allow blade assemblies to rotate relative to the static components without contacting the static components. For example, compressor section 24 includes airfoils 100, blades and/or vanes, in the path of core airflow C. Airfoils 100 may rotate with respect to engine case 36, which may be a compressor case. Sufficient clearance is maintained to allow for vibration and thermal expansion of these components within gas turbine engine 20, while avoiding airfoil 100 contact with engine case 36. Regardless of engine size, a minimum tip clearance is needed between rotating airfoils 100 and engine case 36 to maintain function (i.e. by preventing contact between airfoils 100 and engine case 36) during various operating conditions.

The present disclosure relates to methods of improving efficiency in compressor section 24 and the turbine section 28, particularly in small-core gas turbine engines, wherein "small-core" refers to a core size with a mass flow rate of 3.0 pounds-mass per second (lbm/s) or less. Small-core gas turbine engines may include scaled down engine components relative to larger gas turbine engines. In small-core gas turbine engines, the compressor section 24, for example, may include a scaled down size of the compressor case and airfoils 100 relative to a larger gas turbine engine. A tip clearance may not be scalable with the compressor components. In order to maintain sufficient tip clearance, airfoils 100 may not be scaled down proportionally with the engine case 36. For example, in scaling a compressor section 24 down by a factor of two, the tip clearance may not also be reduced by the same factor without exceeding the minimum tip clearance and causing airfoil 100 contact with the and engine case 36. Thus, a tip clearance may not be proportionally scalable to a small-core engine. The same tip clearance for a larger compressor section 24 may be functional (i.e. by preventing contact between airfoils 100 and engine case 36) in a smaller compressor section 24, but may lead to more inefficiencies in a smaller compressor section 24 relative to a larger compressor section 24. For example, a 0.254 millimeter (mm) (0.01 inch) tip clearance may impact efficiency in a smaller compressor section 24 more than in a larger compressor section 24. High pressure compressor 52 may have a smaller diameter and smaller span airfoils compared low pressure compressor 44. Similarly, an aft section of a compressor, such as low pressure compressor 44 and/or high pressure compressor 52, may have a smaller diameter and smaller span airfoils compared to a forward end of the same compressor. Tip clearance may have a greater impact on efficiency in the high pressure compressor 52 than in the low pressure compressor 44, and further may have a greater impact on efficiency in an aft section of high pressure compressor 52 than in a forward section. Tip clearance may particularly impact the aft-most section of high pressure compressor 52, for example, at an exit of high pressure compressor 52.

As discussed herein, a clearance-to-span ratio may be designed to reduce the impact of tip clearance on efficiency in small-core gas turbine engines. In various embodiments, the blade assemblies of gas turbine engine 20 have a reduced clearance-to-span ratio for improved stability and efficiency.

Figure 2:
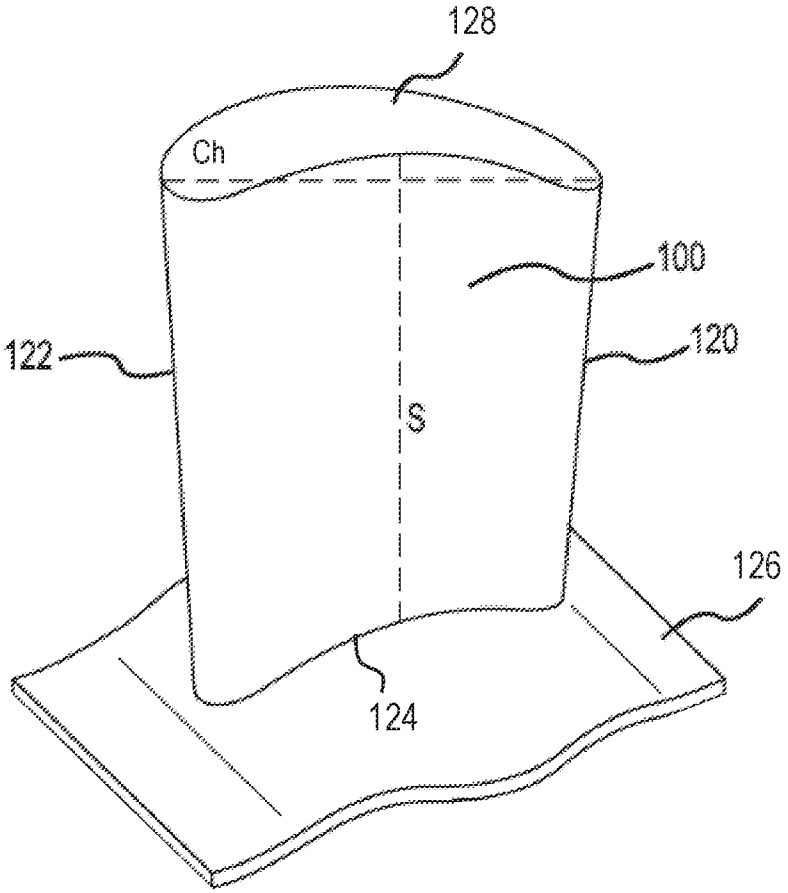
FIG. 2 illustrates a perspective view of an airfoil in a gas turbine engine, in accordance with various embodiments.

With reference to FIG. 2, an airfoil 100 is shown in accordance with various embodiments. Airfoil 100 comprises trailing edge 120 facing an aft direction in a gas turbine engine and leading edge 122 facing a forward direction in the gas turbine engine. Airfoil 100 may include a hub end or root 124 at a radially inner edge of airfoil 100. Root 124 of airfoil 100 may be coupled to a platform 126. For example, airfoil 100 may be coupled and secured to platform 126 by welding, machining, press fitting, and any other acceptable method of coupling. Platform 126 may form a radially inner boundary of a flow path of core airflow C in the gas turbine engine. A radially outer edge or tip 128 of airfoil 100 may be located radially outward from the root 124. Tip 128 of airfoil 100 may face radially outward when airfoil 100 is installed in a rotating compressor section of a gas turbine engine. Airfoil 100 may further include a generally concave pressure side and a generally convex suction side joined together at the respective trailing edge 120 and leading edge 122. A span S of airfoil 100 extends between the root 124 and tip 128 of the airfoil 100. A span S of the airfoil may be described as the height or length of the airfoil in the radial direction and measured radially from root 124 to tip 128 of airfoil 100. A chord Ch of the airfoil 100 extends between the leading edge 122 and the trailing edge 120. A chord at top 124 of airfoil 100 (i.e., the tip chord) is illustrated as chord Ch.

Figure 3:
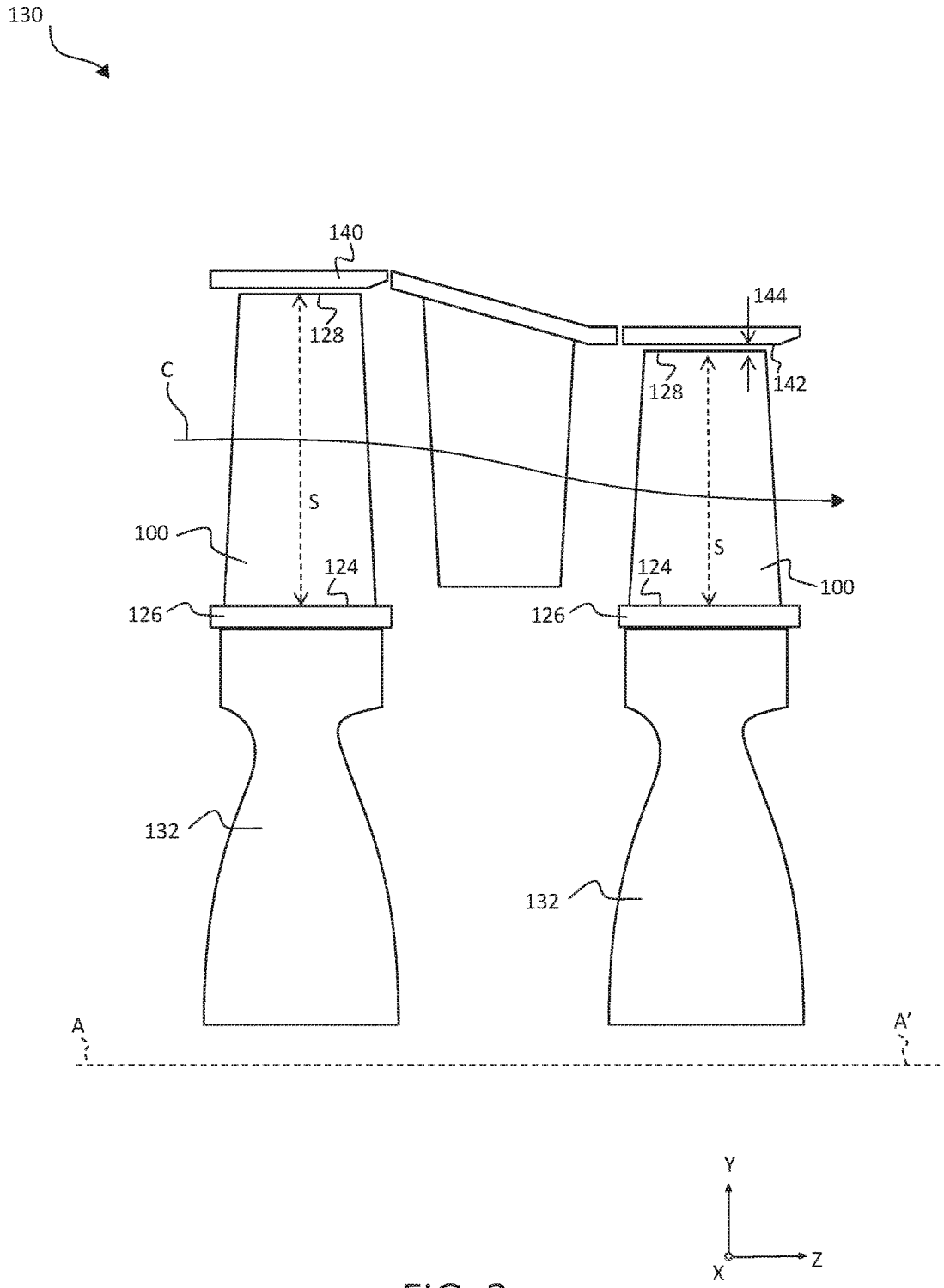
FIG. 3 illustrates a cross-sectional view of an engine section of a gas turbine engine, in accordance with various embodiments.

With reference to FIG. 3, a portion of an engine section 130 is shown in accordance with various embodiments. Engine section 130 may be a compressor section 24 or a turbine section 28. In various embodiments, engine section 130 may be a small-core axial-flow compressor and/or another high pressure compressor or low pressure compressor. Engine section 130 may be a compressor having a mass flow rate of 3.0 lbm/s or less. Engine section 130 may be an aft portion of a high pressure compressor 52 (from FIG. 1), and more particularly, may be an exit stage or aft-most stage of high pressure compressor 52. Engine section 130 may include a plurality of airfoils 100 each coupled to a disk 132 by platform 126. Disk 132 may be centered on the rotation axis of the gas turbine engine with a plurality of airfoils 100 attached to the disk 132 and spaced apart in the circumferential or tangential direction. Disk 132 with airfoils 100 may be configured to rotate about engine central longitudinal axis A-A'. Thus, airfoil 100 may be a rotating member of engine section 130.

Airfoil 100 may rotate with respect to a static member or engine case 140 of engine section 130. Engine case 140 may have a cylindrical wall defining a radially outer boundary of a flow path of core airflow C. Engine case 140 may be, for example, a compressor case. Engine case 140 may extend circumferentially and radially surround airfoils 100. Engine case 140 may include an inner surface 142 adjacent to the tips 128 of the airfoils 100. A radial distance between this inner surface 142 of engine case 140 and the tip 128 of airfoil 100 defines a tip clearance, illustrated by clearance 144. Thus, engine case 140 and airfoil 100 may define a clearance 144 therebetween. Clearance 144 may be a gap between tip 128 of airfoil 100 and inner surface 142 of engine case 140 that allows airfoil 100 to rotate within engine section 130 without contacting engine case 140. A minimum distance of clearance 144 is maintained to prevent contact between tip 128 of airfoil 100 and inner surface 142 of engine case 140.

In various embodiments, a ratio of clearance 144 to span S of airfoils 100 ("clearance-to-span ratio") correlates to an efficiency of the engine section 130. The mass flow rate of core airflow C correlates to the velocity of the airflow and the cross-sectional area of the flowpath, which is determined in part by the span S of airfoil 100. Clearance 144 may allow air to escape from core airflow C through the clearance 144. Reducing a distance of clearance 144 reduces the amount of core airflow C escaping through clearance 144, and thereby increases the stability and efficiency of the engine section 130. However as discussed above, a minimum distance for clearance 144 is maintained to prevent contact between airfoil 100 and engine case 140. Typically, a clearance 144 is translated as a fixed value from a larger sized engine to a smaller sized engine without scaling the clearance 144, i.e., the same clearance is used for a larger and a smaller sized engine, because proportionally scaling clearance 144 down to a small-core engine would exceed the minimum tip clearance and result in contact between rotating and static structures. For a fixed clearance, the ratio of clearance 144 to span S in a smaller engine is relatively greater than in a larger engine. Similarly for the fixed clearance, the ratio of clearance 144 to span S in smaller engine section 130 is relatively greater than in a larger engine section 130. Also for a fixed clearance, a span S of airfoils 100 would not be proportionately scaled down. In other words, when scaling down an engine while maintaining the fixed clearance, a span S would be made disproportionately smaller in the smaller engine to maintain the fixed clearance. Stated another way, the span of an airfoil in a smaller engine (or engine section) is proportionally smaller relative to it's engine components as compared to the relative span of an airfoil in a larger engine (or engine section) with the same clearance.

In various embodiments to improve efficiency of a smaller engine, a clearance-to-span ratio in engine section 130 may be reduced relative to an engine section configured with the fixed clearance of a larger engine. For example, rather than fixing the clearance or proportionally scaling the clearance, airfoils 100 and clearance 144 may be configured to optimize the clearance-to-span ratio in engine section 130. Clearance-to-span ratio of an airfoil 100 may be reduced by increasing span S and/or by decreasing clearance 144. For example, clearance 144 may be designed with a smaller distance in a smaller engine section 130, and still remain within a minimum tip clearance for preventing contact between airfoils 100 and engine case 140. Clearance 144 may be reduced in engine section 130 by decreasing a diameter of engine case 140 relative to the span S of airfoil 100 or by increasing the span S of airfoil 100 relative to a diameter of engine case 140. Clearance 144 may be reduced by both decreasing a diameter of engine case 140 and by increasing the span S of airfoil 100. The span S of airfoil 100 may be increased by extending airfoil 100 radially inward (negative y direction) at root 124 and/or radially outward (positive y direction) at tip 128. For example, lengthening airfoil 100 at root 124 may include decreasing a diameter of disk 132. Decreasing a diameter of disk 132 allows an airfoil 100 having a larger span S to fit within engine case 140, while maintaining clearance 144, and thereby decreasing the clearance-to-span ratio. Thus, span S of airfoil 100 may be increased with or without decreasing clearance 144 and with or without changing a diameter of engine case 140.

In various embodiments, the span S of airfoil 100 is increased relative to clearance 144 by between 20 to 30 percent, and more specifically between 20 to 25 percent. For example, in a small-core compressor, the span S of airfoil 100 may be between about 12.7 millimeters (mm) (0.5 inches) to 15.24 mm (0.6 inches), wherein "about" in this context only means+/−0.25 mm (0.01 inches). More specifically, the span S of airfoil 100 may be between about 14.73 mm (0.58 inches) to 15.24 mm (0.6 inches), wherein "about" in this context only means+/−0.25 mm (0.01 inches). A clearance-to-span ratio for engine section 130 may be described as a ratio of clearance 144 to span S. Increasing the span S of airfoil by 20 to 30 percent may reduce the clearance-to-span ratio to between 0.015:1 and 0.025:1, which may also be expressed as 1.5% to 2.5%. More specifically, the clearance-to-span ratio may be between 0.020:1 and 0.025:1, which may also be expressed as 2.0% to 2.5%. A clearance-to-span ratio of 1.5% to 2.5% may increase the polytropic efficiency of engine section 130 by 1%. A stall margin may be impacted by an increased span S. Thus, airfoils 100 may further be configured to offset stall margin losses by configuring an angle of attack of airfoils 100 to reduce risk of misalignment of airfoils 100 with core airflow C.

In various embodiments, airfoil 100 may be a blade of a high pressure compressor, and more particularly, may be an aft-most blade of a high pressure compressor, such as a small-core high pressure compressor. A compressor diffuses core airflow C to increase the pressure of core airflow C. Diffusion may be expressed a ratio of the exit velocity to the inlet velocity of core airflow C through the compressor. Reducing a clearance-to-span ratio by increasing the span S of airfoil 100 may increase compressor diffusion. Increasing span S may include extending airfoil 100 in a radially outward or radially inward direction. Reducing a diameter of disk 132 may allow airfoil 100 to be configured with a larger span S. Reducing a clearance-to-span ratio may further include decreasing clearance 144 and/or decreasing a diameter of the compressor case to increase compressor diffusion. The span S of airfoil 100 in a small-core compressor may be configured to increase compressor diffusion as compared to typical small-core compressors. A geometrical shape and angle of attack of airfoil 100 may be configured to mitigate stall margin losses.

Figure 4:
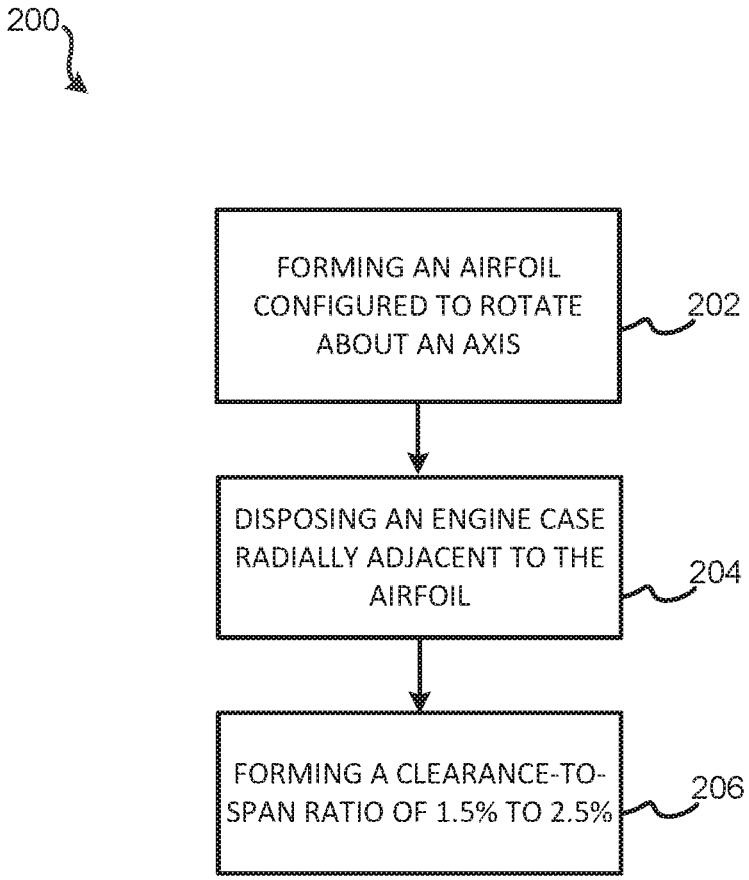
FIG. 4 illustrates a method of increasing gas turbine engine efficiency, in accordance with various embodiments.

With reference to FIG. 4, a method 200 for increasing gas turbine engine efficiency is shown in accordance with various embodiments. Method 200 may comprise the steps of forming an airfoil configured to rotate about an axis (step 202) disposing an engine case radially adjacent to the airfoil (step 204), and forming a ratio of the clearance to the span in a range of 1.5 to 2.5 (step 206). The airfoil 100 has a span S measured radially from a root 124 of the airfoil 100 to a tip 128 of the airfoil 100. Step 206 may further comprise increasing the span S of the airfoil 100 relative to a diameter of the engine section 130. Increasing the span S of the airfoil 100 may include decreasing a diameter of disk 132 to extend airfoil 100 radially inward. Step 206 may further comprise reducing the ratio of the clearance 144 to the span S by increasing the span S of the airfoil 100 relative to a diameter of the engine section 130. Step 206 may further comprise increasing the span S of the airfoil 100 to between 12.7 millimeters and 15.24 millimeters. Step 206 may further comprise reducing the ratio of the clearance 144 to the span S by decreasing a diameter of the engine case 140 relative to the span S of the airfoil 100. The airfoil 100 may be a high pressure compressor airfoil and engine case 140 may be a compressor case.

Benefits and other advantages have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, and any elements that may cause any benefit or advantage to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C.

Systems, methods and apparatus are provided herein. In the detailed description herein, references to "various embodiments", "one embodiment", "an embodiment", "an example embodiment", etc., indicate that the embodiment described may include a particular feature, structure, or characteristic, but every embodiment may not necessarily include the particular feature, structure, or characteristic.

Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element is intended to invoke 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A compressor, comprising:

an airfoil configured to rotate about an axis, wherein the airfoil has a span measured radially from a root of the airfoil to a tip of the airfoil; and a compressor case radially adjacent to the airfoil, wherein the airfoil and the compressor case define a clearance between the tip of the airfoil and a radially inner surface of the compressor case and wherein a ratio of the clearance to the span is between 1.5 and 2.5 percent, wherein a mass flow rate of the compressor is 3.0 pounds-mass per second or less, wherein the span of the airfoil is between about 14.73 millimeters and about 15.24 millimeters.

2. The compressor of claim 1, wherein the ratio of the clearance to the span is between 2.0 and 2.5 percent.

3. The compressor of claim 1, wherein the airfoil is a high pressure compressor airfoil.

4. The compressor of claim 1, wherein the clearance is configured to prevent contact between the tip of the airfoil and the radially inner surface of the compressor case.

5. The compressor of claim 1, wherein the airfoil is positioned in an aft end of the compressor.

6. A gas turbine engine, comprising:

an engine section comprising a compressor;

an airfoil positioned within the engine section and configured to rotate about an axis, wherein the airfoil has a span measured radially from a root of the airfoil to a tip of the airfoil; and an engine case radially adjacent to the airfoil, wherein the airfoil and the engine case define a clearance between the tip of the airfoil and a radially inner surface of the engine case and wherein a ratio of the clearance to the span is between 1.5 and 2.5 percent, wherein a mass flow rate of the compressor is 3.0 pounds-mass per second or less, wherein the span of the airfoil is between about 14.73 millimeters and about 15.24 millimeters.

7. The gas turbine engine of claim 6, wherein the ratio of the clearance to the span is between 2.0 and 2.5 percent.

8. The gas turbine engine of claim 6, wherein the airfoil is a high pressure compressor airfoil.

9. The gas turbine engine of claim 8, wherein the engine case is a compressor case.

10. The gas turbine engine of claim 6, wherein the engine section is an aft portion of a high pressure compressor.

11. A method of increasing gas turbine engine efficiency, comprising:

forming an airfoil configured to rotate about an axis, wherein the airfoil has a span measured radially from a root of the airfoil to a tip of the airfoil, wherein the airfoil is a high pressure compressor airfoil having a mass flow rate of 3.0 pounds-mass per second or less;

disposing an engine case radially adjacent to the airfoil, wherein the airfoil and the engine case define a clearance between the tip of the airfoil and a radially inner surface of the engine case; and forming a ratio of the clearance to the span in a range of 1.5 to 2.5 percent, wherein the forming the ratio of the clearance to the span includes increasing the span of the airfoil to between about 14.73 millimeters and about 15.24 millimeters.

12. The method of claim 11, wherein the forming the ratio of the clearance to the span includes decreasing a diameter of the engine case relative to the span of the airfoil.

13. The method of claim 11, wherein the engine case is a compressor case.

* * * * *